US010869366B2

(12) United States Patent
Rojo-Calderon et al.

(10) Patent No.: US 10,869,366 B2
(45) Date of Patent: Dec. 15, 2020

(54) PARTICLE AND AEROSOL-FORMING SYSTEM COMPRISING SUCH PARTICLES

(71) Applicant: PHILIP MORRIS PRODUCTS S.A., Neuchatel (CH)

(72) Inventors: Noelia Rojo-Calderon, Neuchatel (CH); Rui Nuno Batista, Morges (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 255 days.

(21) Appl. No.: 15/768,129

(22) PCT Filed: Oct. 21, 2016

(86) PCT No.: PCT/EP2016/075308
§ 371 (c)(1),
(2) Date: Apr. 13, 2018

(87) PCT Pub. No.: WO2017/068092
PCT Pub. Date: Apr. 27, 2017

(65) Prior Publication Data

US 2018/0317286 A1 Nov. 1, 2018

(30) Foreign Application Priority Data

Oct. 22, 2015 (EP) ..... 15190934

(51) Int. Cl.
*H05B 6/10* (2006.01)
*A24F 47/00* (2020.01)

(52) U.S. Cl.
CPC ..... *H05B 6/106* (2013.01); *A24F 47/008* (2013.01)

(58) Field of Classification Search
CPC ..... H05B 6/106; A24F 47/008
USPC ..... 219/600, 606, 628, 634; 131/369, 335, 131/370, 194, 329, 273; 128/203.17, 128/202.21, 203.27
See application file for complete search history.

(56) References Cited

U.S. PATENT DOCUMENTS 4,858,630 A 8/1989 Banerjee
5,060,671 A * 10/1991 Counts ..... A24F 47/008 131/329

(Continued)

FOREIGN PATENT DOCUMENTS

CN 87108020 A 6/1988
CN 1126426 A 7/1996

(Continued)

OTHER PUBLICATIONS

PCT Search Report and Written Opinion for PCT/EP2016/075308 dated Jan. 24, 2017 (11 pages).

(Continued)

*Primary Examiner* — Quang T Van
(74) *Attorney, Agent, or Firm* — Oblon, McClelland, Maier & Neustadt, L.L.P.

(57) ABSTRACT

A particle includes a core of susceptor material and a first coating including a first aerosol-forming substrate. The core of susceptor material is coated with the first coating including the first aerosol-forming substrate. Additionally, an aerosol-generating system includes a plurality of such particles. The system further includes an inductor for being inductively coupled to the core of susceptor material of at least some particles of the plurality of particles.

17 Claims, 2 Drawing Sheets

(56) References Cited

U.S. PATENT DOCUMENTS

| | | | | |
|---|---|---|---|---|
| 5,105,831 | A | 4/1992 | Banerjee et al. | |
| 5,613,505 | A | 3/1997 | Campbell | |
| 2015/0245669 | A1 | 9/2015 | Cadieux | |
| 2018/0289067 | A1* | 10/2018 | Courbat | A24F 47/008 |

FOREIGN PATENT DOCUMENTS

| | | |
|---|---|---|
| WO | WO 95/27411 | 10/1995 |
| WO | WO 2015/082652 | 6/2015 |

OTHER PUBLICATIONS

Decision to Grant issued in Russia for Application No. 2018118551 dated Dec. 19, 2019 (7 pages).
Combined Chinese Office Action and Search Report issued Jun. 28, 2020 in Patent Application No. 201680061140.7 (with English language translation), 14 pages.
European Office Action issued Jul. 15, 2020 in European Patent Application No. 16785135.1, 4 pages.

* cited by examiner

PARTICLE AND AEROSOL-FORMING SYSTEM COMPRISING SUCH PARTICLES

This application is a U.S. National Stage Application of International Application No. PCT/EP2016/075308, filed Oct. 21, 2016, which was published in English on Apr. 27, 2017, as International Publication No. WO 2017/068092 A1. International Application No. PCT/EP2016/075308 claims priority to European Application No. 15190934.8 filed Oct. 22, 2015.

BACKGROUND

The invention relates to particles having a core of a susceptor material for being inductively heated. The invention also relates to an aerosol-generating system comprising such particles.

In aerosol-generating heating systems known from the prior art a tobacco containing material of a consumable is heated by a heating element for aerosol formation. Often, a contact between the heating element and the tobacco containing material is unsatisfactory. Thus, heating may be insufficient, in particular a heat transfer and distribution over an entire amount of tobacco material. This in turn may cause waste of unused tobacco material.

Therefore, it would be desirable to have an aerosol-forming substrate having good heat contact to a heating element. In particular, it would be desirable to have an inductively heatable aerosol-forming substrate providing flexibility relating to its application in aerosol-generating devices.

BRIEF SUMMARY

According to an aspect of the present invention, there is provided a particle comprising a core of susceptor material and a first coating comprising a first aerosol-forming substrate. The core of susceptor material is coated with the first coating comprising the first aerosol-forming substrate.

The coating of the core of susceptor material with aerosol-forming substrate provides a very close and direct physical contact between the substrate and the susceptor material. Thus, heat transfer from the susceptor to the substrate is optimized. The close contact may lead to a very homogeneous temperature profile across the aerosol-forming substrate in the first coating. Unused substrate, for example in peripheral portions of otherwise known tobacco plugs may be avoided. Also a total amount of substrate may be reduced due to an efficient use of the substrate. Waste of material or costs are thus reduced. Another advantage is that overheating of the aerosol-forming substrate may be prevented and thus combustion of the substrate and combustion products formed may be reduced or prevented. The amount of heating energy may be reduced, which may in particular be advantageous in view of longer operation time of a device or in view of battery capacity or battery size of an electronic heating device. Improved heat transfer and large contact areas may also lead to a faster heating-up of the aerosol-forming substrate and thus to shorter start-up times and less energy required for a device to get ready for use.

For use of the particle according to the invention in an electronic heating device, for example, a cavity of a standard induction heating device may be filled with a plurality of particles without requiring design changes of the device. In addition, due to the aerosol-forming substrate being in particle form, basically any form of cavity may be filled with the particles. A cavity may also only partly be filled with particles. Thus, a dosing regime may be chosen and varied according to a user's needs. Yet further, a composition of a plurality of particles heated in a heating device may be varied as desired to achieve a specific consuming experience. The specific consuming experience may be varied by varying the composition of the plurality of particles.

The particles according to the invention may directly be used in a heating device, not requiring, for example, any further processing step. Such further processing step may, for example, be an assembly with other elements to form an aerosol-generating stick or a forming step to fit into a capsule or cavity.

Particles may be granules or flakes, for example having round or flat shapes, having regular or irregular shapes or surfaces. Granules may for example be beads or grit. A particle according to the invention may comprise a single or several coatings. A particle may comprise a core comprising a single susceptor particle or several susceptor particles.

A granule is herein defined as being an element having a shape, wherein any dimension is smaller than twice of any other dimension. The shape may be round, substantially round or angular. A surface of the granule may be angular, rough or smooth.

A flake is herein defined as being an element having a shape having one predominant dimension, which predominant dimension is at least twice as large as any other dimension. Preferably, a flake has at least one surface that is substantially flat.

Advantageously, a particle according to the invention has a maximum size of 6 mm, preferably 4 mm, more preferably 2 mm.

Preferably, a particle, or a largest dimension of a particle if not of substantially round shape, is not smaller than 0.2 mm, preferably not smaller than 0.5 mm.

Such sizes of particles have shown to provide much flexibility when filling cavities of heating devices, wherein the cavities may be of various different sizes or shapes.

In addition, particle sizes in this range allow the manufacture of particles having an optimized ratio of susceptor material to aerosol-forming substrate. A ratio of an amount of susceptor material to an amount of aerosol-forming substrate may be varied. However, preferably such a ratio is fixed within a certain range.

A ratio of an amount of susceptor material to an amount of aerosol-forming substrate may be 1:1 to 1:4, preferably 1:1.5 to 1:2.5. The ratios are considered volumetric ratios.

Ratios in this range are favorable with respect to efficient and preferably homogenous heating of the aerosol-forming substrate and aerosol-production. The ratio may be configured such that heating is performed in a manner to provide a consistent substance delivery, preferably nicotine delivery to a user.

The core of susceptor material may be a susceptor particle such as a susceptor granule or susceptor flake. The susceptor particle may, for example have a round or flat shape, have a regular or irregular shape or surface. A susceptor granule may for example be a susceptor bead or susceptor grit.

In general, a susceptor is a material that is capable of absorbing electromagnetic energy and converting it to heat. When located in an alternating electromagnetic field, typically eddy currents are induced and hysteresis losses occur in the susceptor causing heating of the susceptor. In the particles according to the invention, changing electromagnetic fields generated by one or several inductors, for example, induction coils of an inductive heating device heat the susceptor core, which then transfers the heat to the surrounding coating or coatings of aerosol-forming substrate, mainly by conduction of heat such that an aerosol is formed. Such a transfer of heat is best, if the susceptor is in close thermal contact with tobacco material and aerosol former of the aerosol-forming substrate coating as in the present invention. Due to the coating process, a close interface between core of susceptor material and first coating of aerosol-forming substrate is formed.

The susceptor may be formed from any material that can be inductively heated to a temperature sufficient to generate an aerosol from the aerosol-forming substrate and that allow the manufacture of susceptor particles such as granules or flakes. Preferred susceptors comprise metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example Fe, Co, Ni, or metalloids components such as for example B, C, Si, P, Al.

Preferably, the core of susceptor material is a metallic susceptor particle.

The susceptor may also be a multi-material susceptor and may comprise a first susceptor material and a second susceptor material. The first susceptor material may be disposed in intimate physical contact with the second susceptor material. The second susceptor material preferably has a Curie temperature that is below the ignition point of the aerosol-forming substrate. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Suitable materials for the second susceptor material may include nickel and certain nickel alloys.

By providing a susceptor having at least a first and a second susceptor material, the heating of the aerosol-forming substrate and the temperature control of the heating may be separated. Preferably the second susceptor material is a magnetic material having a second Curie temperature that is substantially the same as a desired maximum heating temperature. That is, it is preferable that the second Curie temperature is approximately the same as the temperature that the susceptor should be heated to in order to generate an aerosol from the aerosol-forming substrate.

Susceptor granules such as beads and grits may be manufactured from melting a raw material, for example an alloy, to create metal droplets. For manufacturing the beads, which are substantially round but may have a spherical or irregular spherical (angular) shape, the droplets may be reshaped and sieved to obtain a specific granulometry range.

For manufacturing grits, which are substantially round but have angular shapes, the droplets may be crushed into angular particles and sieved to obtain a specific granulometry range. Grits may also be obtained from industrial residues of stainless steel processing factories, for example, residues caused by manufacturing medical tools or processing medical grade alloys. These residues may be trimmed and crushed and sieved to obtain a specific granulometry range.

Susceptor flakes may be manufactured, for example, by milling techniques using various raw material including recycling material as mentioned above. For manufacturing flakes, which have a substantially flat shape with a spherical or irregular spherical (angular) circumferential shape, the raw materials are processed, for example in several processing steps, to obtain flakes in a defined thickness and overall size range. Preferably, in a processing step, it is ascertained that the flakes do not agglomerate and that no fragmentation of the flakes into smaller particles occurs.

A size of a susceptor granule, for example a bead or grit, may be between 0.2 mm and 2.4 mm, preferably between 0.2 mm and 1.7 mm, more preferably between 0.3 mm and 1.2 mm.

A maximal length of a susceptor flake may be between 0.2 mm and 4.5 mm, preferably between 0.4 mm and 3 mm, more preferably between 0.5 mm and 2 mm.

A thickness of susceptor flakes may be between 0.02 mm and 1.8 mm, preferably between 0.05 mm and 0.7 mm, more preferably between 0.05 mm and 0.3 mm.

Advantageously, a core of susceptor material consists of one particle. However, a core of susceptor material may comprise several particles, for example two particles. If several particles form a susceptor core, then the sum of the sizes of the several particles is within the given granulometry range mentioned herein.

A susceptor particle may be partially or entirely porous. A susceptor particle may be massive or hollow.

Advantageously, for susceptor particles susceptor materials are used having melting temperatures between 1450 degree Celsius and 1500 degree Celsius. Particle densities may be between 5 g/cm3 and 9 g/cm3, preferably between 6 g/cm3 and 8 g/cm3. A bulk density, which is dependent on a particle size, may be between 2.8 g/cm3 and 6.6 g/cm3, preferably between 3.5 g/cm3 and 4.7 g/cm3 for beads and flakes. A bulk density of grit may be in a slightly more narrow density range between 3.1 g/cm3 and 6.2 g/cm3, preferably between 3.8 g/cm3 and 4.1 g/cm3. A hardness of susceptor beads and flakes may be between 30 HRC to 70 HRC (Rockwell scale), preferably between 30 HRC and 50 HRC, wherein a hardness of susceptor grits, preferably is between 30 HRC and 70 HRC, more preferably between 40 HRC and 60 HRC.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

Aerosol-forming substrate may be a tobacco containing aerosol-forming substrate. The aerosol-forming substrate may be provided in the form of a slurry. Depending on a coating method for applying a first substrate coating onto a susceptor core or, as will be described further below, a second or further coating of aerosol-forming substrate onto a previous aerosol-forming substrate coating, a moisture content of the slurry may vary.

The tobacco containing slurry and the first coating comprising the first aerosol-forming substrate made from the tobacco containing slurry or—as the case may be—a second or further coating comprising a second or further aerosol-forming substrate, comprises tobacco particles, fiber particles, aerosol former, binder and for example also flavours. Preferably, a coating is a form of reconstituted tobacco that is formed from the tobacco containing slurry.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired coating thickness.

Fiber particles may include tobacco stem materials, stalks or other tobacco plant material, and other cellulose-based fibers such as wood fibers having a low lignin content. Fiber particles may be selected based on the desire to produce a sufficient tensile strength for the coating versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry for forming the coating may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. An aerosol former may be chosen based on its ability, for example, to remain stable at or around room temperature but able to volatize at a higher temperature, for example, between 40 degree Celsius and 450 degree Celsius. The aerosol former may also have humectant type properties that help maintain a desirable level of moisture in an aerosol-forming substrate when the substrate is composed of a tobacco-based product including tobacco particles. In particular, some aerosol formers are hygroscopic material that function as a humectant, that is, a material that helps keep a substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

A typical process to produce a slurry for a tobacco containing aerosol-forming substrate includes the step of preparing the tobacco. For this, tobacco is shredded. The shredded tobacco is then blended with other kinds of tobacco and grinded. Typically, other kinds of tobacco are other types of tobacco such as Virginia or Burley, or may for example also be differently treated tobacco. The blending and grinding steps may be switched. The fibers are prepared separately and preferably such as to be used for the slurry in the form of a solution. Since fibers are mainly present in the slurry for providing stability to a coating, the amount of fibers may be reduced or fibers may even be omitted due to the aerosol-forming substrate coating being stabilized by the core of susceptor material.

If present, the fiber solution and the prepared tobacco are then mixed. The slurry is then transferred to a coating or granulation device. After single or multiple-coating with the same or different slurries, the particles are then dried, preferably by heat and cooled after drying.

Preferably, the tobacco containing slurry comprises homogenized tobacco material and comprises glycerin as aerosol former. Preferably, the first coating of aerosol-forming substrate is made of a tobacco containing slurry as described above. Preferably, a second and further coating of aerosol-forming substrate is made of a tobacco containing slurry as described above.

Advantageously, aerosol-forming substrate surrounding the core of susceptor material is porous to allow volatilized substances to leave the substrate. Due to the aerosol-forming substrate forming a coating of the susceptor material, only a small amount of substrate must be heated by one susceptor core, compared to aerosol-forming substrates heated by, for example, a heating blade. Thus, also coatings having no or only little porosity may be used. A coating with small thickness may, for example, be chosen to have less porosity than a coating with large thickness.

Advantageously, a first thickness of the first coating is between 0.05 mm and 4.8 mm, preferably, between 0.1 mm and 2.5 mm.

A particle according to the invention may further comprise a second coating comprising a second aerosol-forming substrate. The second coating is coating the first coating. Advantageously, a second thickness of the second coating is between 0.05 mm and 4 mm, preferably between 0.1 mm and 1.3 mm.

The first coating comprising the first aerosol-forming substrate and the second coating comprising the second aerosol-forming substrate may be identical. Preferably, the first coating comprising the first aerosol-forming substrate and the second coating comprising the second aerosol-forming substrate differ in at least one of composition, porosity, coating thickness or shape of coating surface.

By choosing more than one but differing aerosol-forming substrates, aerosolization may be varied and controlled for a given inductive heating device. Also the delivery of different substances, such as, for example, nicotine or flavours may be varied and controlled for a given inductive heating device. In particular, an aerosol-generating system with customized performance may be provided.

The particle may be provided with further coatings comprising further aerosol-forming substrates. Advantageously, the further coatings are different from the first or second coating. Preferably, a thickness of further coatings is smaller than a thickness of the first or second coating or a previous further coating.

Different coating specifics may be achieved by providing coating materials having different material compositions or different amounts of the same materials. Different coating specifics may also be achieved by different coating techniques. Different coating techniques are preferably chosen for achieving different coating surfaces or substrate densities of a coating. For example, coating techniques having a rotative chamber generally provide smother coating surfaces, while wet granulation equipment may be preferred for obtaining rough coating surfaces.

The particle according to the invention may further comprise at least one protection layer. A protection layer may, for example, assure or enhance a shelf life of a particle. Additionally or alternatively a protection layer may optimize use and vaporization behaviour of a particle.

A protection layer may be an outer protection layer protecting the particle and its coating materials against environmental influences. Preferably, an outer layer is a moisture protection layer. Preferably, an outer protection layer is an outermost material of the particle.

A protection layer may also be an inner protection layer, for example, arranged between the first coating and the second coating. Such an inner protection layer may form a chemical barrier between the first and the second coating or between any two coatings. An inner protection layer may be favourable, if a contact between first coating and second coating (or in general between coatings the inner protection layer is arranged in) shall be allowed only upon consumption of the product.

A protection layer may also be used for marking purposes, for example, by adding a colour to an outer protection layer.

Particles according to the invention may basically be coated with one or several coatings by any kind of wet granulation or dry granulation or wet coating or dry coating. Wet or dry coating may be, for example, powder or slurry coating or rotary coating. Wet granulation may, for example, be batch or continuous fluid-bed granulation, bottom or top-spray granulation. Dry granulation may, for example include shear granulation, spheronization or rotor granulation. Dry granulation is preferably used for the manufacture of particles in the form of granules.

Preferably, the particle according to the invention is coated with one or two coatings according to any one of the above coating methods.

These coating methods are standard reliable industrial processes that allow for mass production of coated particles. These coating processes also enable high product consistency in production and repeatability in performance of the particles.

According to another aspect of the invention, there is provided an aerosol-generating system. The aerosol-generating system comprises a plurality of particles, each particle comprising a core of susceptor material and at least one coating comprising an aerosol-forming substrate. The plurality of particles may comprise at least two particles. However, the plurality of particles preferably comprises several to several tens or a few hundred of particles. Preferably, the plurality of particles comprises a maximum number of 200 particles, for example between 10 and 200 particles or between 50 and 150 particles.

The system further comprises a power source connected to a load network. The load network comprises an inductor, for example one or more induction coils, for being inductively coupled to the core of susceptor material of at least some particles of the plurality of particles. If one induction coil only is provided, the single induction coil is inductively coupled to the plurality of particles. If several induction coils are provided, each induction coil may heat different particles of the plurality of particles or individual portions of the entirety formed by the plurality of particles. Due to the presence of a plurality of particles, the entirety formed by the plurality of particles is very homogeneous. Thus, it is possible to improve consistency in aerosol formation between puffs during a consuming experience as well as repeatability between consuming experiences. In addition, also when heating different individual portions of the entirety (segmented heating), that is, portions of the plurality of particles, a homogenous or consistent aerosol generation is provided.

The aerosol-generating system may comprise an aerosol-generating device. The device may comprise a device housing comprising a cavity arranged in the device housing. The cavity contains the plurality of particles. The device may further comprise a closure closing a proximal end of the cavity. Therein, the closure comprises at least one opening for aerosol generated by the plurality of particles in the cavity to pass through the closure. On the other hand, the at least one opening has a size smaller than a size of a smallest particle of the plurality of particles, thereby retaining the plurality of particles in the cavity. The closure may comprise a plurality of openings, for example an irregular or regular arrangement of openings, for example openings in a porous material or interstices as in a grid, mesh or web.

Preferably, the closure is made of a porous material, preferably an air-permeable porous material or is in the form of a grid, web or mesh. Mesh sizes are smaller than the sizes of particles in the cavity. Preferably, mesh sizes are smaller than the smallest size or dimension of particles in the cavity. For example, if particles in the form of flakes having a narrow width are used, the at least one openings or the several openings in a closure are smaller than either the thickness or the width of the flakes, whichever dimension is smaller. Advantageously, grids or meshes are used as closure, having grid openings smaller than 6 mm, preferably smaller than 4 mm, more preferably smaller than 2 mm.

A closure may be a separate element by which the cavity may be closed after filling the cavity. The closure may also be an integrated element of the device. The closure may, for example, be integrated into a mouthpiece of the device. For example, the closure may form the distal end of the mouthpiece. For filling the cavity or for removing used particles from a cavity, the mouthpiece may be removed. After filling the cavity with fresh particles, for example with an individually chosen amount of particles, the mouthpiece may be mounted to the device housing again and the system is ready for use.

The closure may be made of any material suitable for use in the system according to the invention and in aerosol-generating heating devices. Preferably, the closure is made of a same material as a mouthpiece, for example, integrally formed with the mouthpiece. Preferably, the closure is made of plastics material, for example, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, 5 polyurethane resins and vinyl resins.

A plurality of particles filled into a cavity of a heating device may all be identical particles, that is particles having, for example, identical compositions, shapes, sizes or aerosol delivery profiles. However, a plurality of particles filled into a cavity may comprise different types of particles. Different types of particles may differ in at least one of number of coatings, for example one or two coatings; size of the particles; shape of the particles, for example rough or smooth surface, spherical or angular; shape or composition of susceptor material, for example granules or flakes having a same or different surface structure or material composition; thickness of one or several aerosol-forming substrate coatings; porosity or composition of one or several aerosol-forming substrate coatings or may differ in aerosol delivery profiles.

This variability and flexibility of an inductively heatable aerosol-forming product allows customization of a consuming experience, which is not possible with other kind of aerosol-generating articles essentially having a "one-piece" consumable.

According to yet another aspect of the invention, there is also provided an aerosol-generating device for use in the aerosol-generating system according to the invention. The device comprises a device housing comprising a cavity arranged in the device housing. The cavity has an internal surface adapted to accommodate a plurality of particles comprising a core of susceptor material and at least a coating comprising aerosol-forming substrate, preferably a plurality of particles according to the invention and as described herein. The device further comprises an inductor of a load network, which inductor is inductively coupled to the core of susceptor material of the plurality of particles during operation. The device also comprises a mouthpiece having a distal end closing the cavity. The distal end comprises a grid, mesh or web. Preferably, the grid, mesh or web is an integral part of the mouth piece.

Further aspects and advantages of the device have been mentioned relating to the system according to the invention and will not be repeated.

BRIEF DESCRIPTION OF THE DRAWINGS

The invention is further described with regard to embodiments, which are illustrated by means of the following drawings, wherein:

FIG. 6); flakes (FIG. 7);

DETAILED DESCRIPTION

Figures 1A, 1B, 1C:
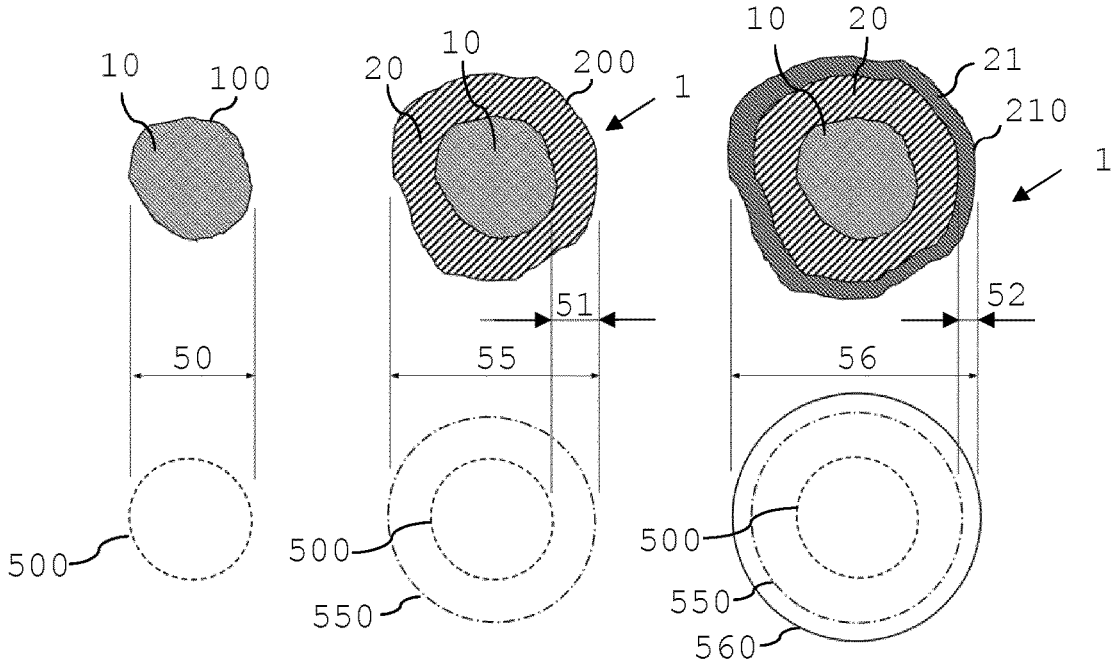
FIG. 1*a-c* show cross sections of a susceptor granule before and after two coating steps with aerosol-forming substrate.

FIG. 1*a* shows a cross section of a susceptor core particle in the form of a granule 10 with rough surface 100. In FIG. 1*b* the susceptor core particle 10 is coated with a first coating of aerosol-forming substrate 20. This first coating 20 also has a rough surface 200. In FIG. 1*c* a second coating 21 of aerosol-forming substrate coats the first coating 20. Also this second coating 21 is provided with a rough surface 210. The aerosol-forming substrate of the first coating and of the second coating may be the same or different, for example different in any one or a combination of composition, density, porosity, coating thickness.

The particles 1 shown in FIGS. 1*b* and 1*c* in the form of granules formed by the susceptor core 10 coated with one or two aerosol-forming substrate coatings 20,21 form particles 1 according to the invention, which particles 1 are inductively heatable and ready for use in an inductive heating device.

Preferably, the susceptor granule 10 is a metallic granule made of a metal or metal alloy, for example an austenitic or martensitic stainless steel. Preferably, the first and second aerosol-forming substrate coatings 20,21 are tobacco containing substrate coatings. In the embodiment shown in FIGS. 1*b* and 1*c*, the second coating 21 has about half of the thickness of the first coating 20.

Sizes of particles, as well as of coatings may be determined by average circumferences 500,550,560 as shown in the lower part of FIGS. 1*a-c*. Susceptor granules, as well as the final granules 1 often do not have an exact round shape such that an average diameter 50,55,56 or an average coating thickness 51,52 is determined for the susceptor granules 10 and the final granules 1.

An average diameter 50 for a susceptor granule 10 may be in a range between 0.1 millimeter and 4 millimeter, preferably between 0.3 millimeter and 2.5 millimeter.

An average thickness 51 for a first aerosol-forming substrate coating 20 may be in a range between 0.05 millimeter and 4.8 millimeter, preferably between 0.1 millimeter and 2.5 millimeter.

Thus, an average diameter 55 of a granule comprising one coating 20 of aerosol-forming substrate may be between 0.2 millimeter and a maximum of 6 millimeter, preferably between 0.5 millimeter and 4 millimeter.

An average thickness 52 for a second aerosol-forming substrate coating 21 may be in a range between 0.05 millimeter and 4 millimeter, preferably between 0.1 millimeter and 1.3 millimeter.

Thus, an average diameter 56 of a granule comprising two coatings 20,21 of aerosol-forming substrate may be between 0.3 millimeter and a maximum of 6 millimeter, preferably between 0.7 millimeter and 4 millimeter.

While a maximum particle size is 6 millimeter, preferably 4 millimeter, even more preferably 2 millimeter, an average diameter 55 of the particle shown in FIG. 1*b* having one coating is typically smaller than an average diameter 56 of the particle shown in FIG. 1*c* having two coatings.

When using a tobacco and aerosol-former containing slurry as aerosol-forming substrate coating, preferably a fluid bed granulation method is used for high volume production of particles 1. If low moisture slurry is used, preferably, powder granulation methods may be used for particle production. Preferably rotative coating granulators are used for the manufacture of granules.

Figures 2A, 2B, 2C:
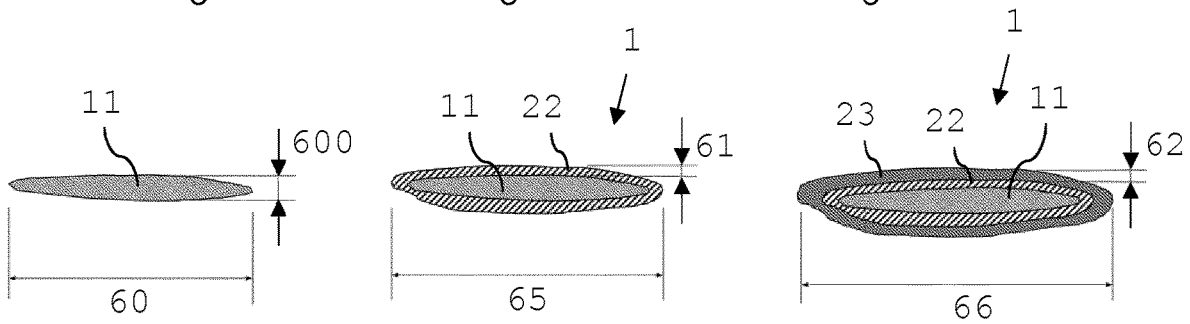
FIG. 2*a-c* show cross sections of a susceptor flake before and after two coating steps with aerosol-forming substrate.

FIG. 2*a* shows a cross section of a susceptor core particle in the form of a flake 11. In FIG. 2*b* the susceptor flake 11 is coated with a first coating of aerosol-forming substrate 22. In FIG. 2*c* a second coating 23 of aerosol-forming substrate coats the first coating 22. A plurality of the inductively heatable flake 1 as shown in FIG. 2*b* or FIG. 2*c* may be used in an inductively heatable device for aerosol generation.

A diameter 60 of a susceptor flake may be between 0.2 millimeter and 4.5 millimeter, preferably between 0.5 millimeter and 2 millimeter. A thickness 600 of the susceptor flake may be between 0.02 millimeter and 1.8 millimeter, preferably between 0.05 millimeter and 0.3 millimeter.

A thickness 61,62 for a first and a second aerosol-forming substrate coating 22,23 may be in the same ranges and in the same preferred ranges as the thicknesses for the above described coatings for granules.

Thus, a diameter 65 of a flake 1 coated with one aerosol-forming coating as shown in FIG. 2*b* may be in a range between 0.3 millimeter and a maximum of 6 millimeter, preferably between 0.7 millimeter and 4 millimeter. A thickness of a flake 1 coated with one aerosol-forming coating 22 may be in a range between 0.12 millimeter and a maximum of 6 millimeter, preferably between 0.25 millimeter and 4 millimeter.

A diameter 66 of a flake 1 coated with two aerosol-forming coatings 22,23 as shown in FIG. 2*c* may be in a range between 0.4 millimeter and a maximum of 6 millimeter, preferably between 0.9 millimeter and 4 millimeter. A thickness of a flake 1 coated with two aerosol-forming coatings may be in a range between 0.22 millimeter and a maximum of 6 millimeter, preferably between 0.45 millimeter and 4 millimeter.

Figure 3:
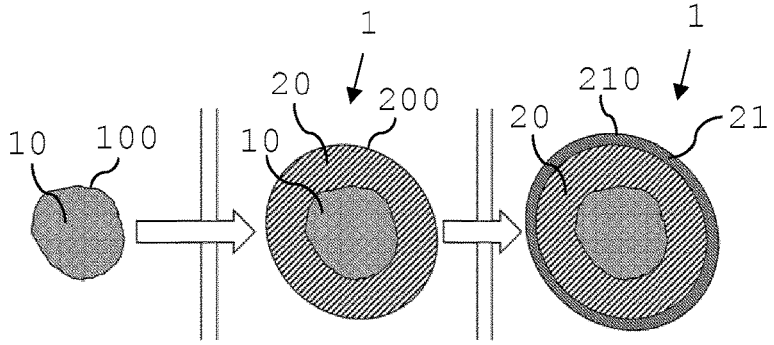
FIG. 3 illustrates aerosol-forming substrate coatings with smooth surfaces.

FIG. 3 shows cross sections of a susceptor granule 10 with rough surface 100 that is coated with a first aerosol-forming substrate coating 20 and a second aerosol-forming substrate coating 21. The granule 1 formed after the first coating 20 has a smooth surface 200. Also after application of the second coating 21, the surface 210 of the second coating is smooth providing a granule 1 having a smooth surface.

It becomes clear from the examples shown in FIGS. 1, 2 and 3 that surfaces of core particles and of different coatings may be rough or smooth, independent of each other and may be the result of a desired manufacturing process or may be chosen according to a desired result. A surface characteristic may be chosen independently of a composition, compaction or density of a coating. It also becomes clear that also further aerosol-former substrate coatings may be applied, for example a third or fourth coating, however, within a granulometry range defined herein, that is, keeping a maximum particle size in the size range defined herein.

In addition, a protection layer may be provided in between individual coatings or, preferably, as most outer layer of the particle 1. Preferably, an outer protection layer is provided as moisture protection but may in combination or alternatively be used as marking layer. For example, a specific colour may be indicative of a specific flavour or aerozolization profile when used in a specific heating device.

Figure 4:
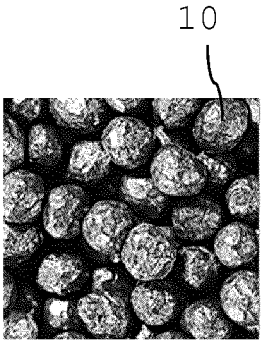
FIGS. 4 to 7 show susceptor particles in the form of regular round particles (FIG. 4); irregular round particles (FIG. 5); grit (angular form.
Figure 5:
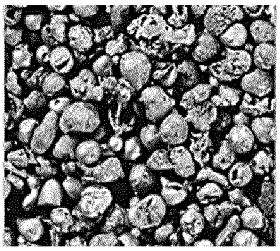
Figure 6:
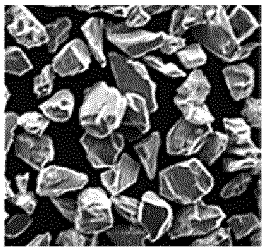
Figure 7:
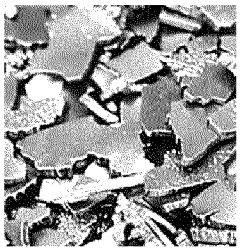

FIGS. 4 to 7 show examples of susceptor particles of different forms that are suitable as susceptor core in the manufacture of particles according to the invention. In FIG. 4 a plurality of susceptor particles in the form of regularly sized spheres or beads is shown. FIG. 5 shows a plurality of susceptor particles, wherein the particles are irregularly sized spheres or beads. FIG. 6 shows susceptor core particles in the form of grit. The susceptor particles basically have the form of granules not having any predominant dimension, however, the shapes of the granules are angular and irregular (various flat surface sections for example combined with rounded surface sections). In FIG. 7 susceptor flakes are shown. The flakes are flat, mostly having two parallel flat sides but of irregular circumferential shape.

Figure 8:
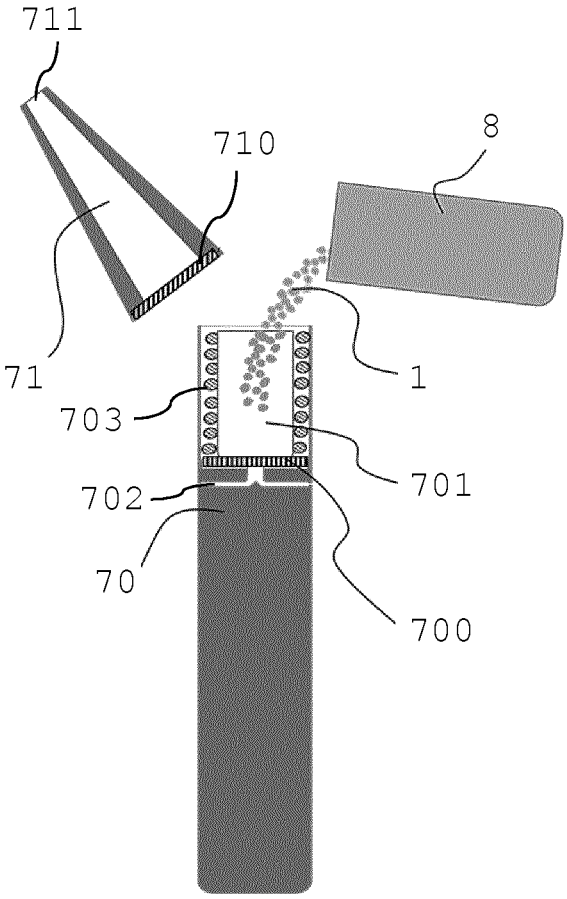
FIG. 8 schematically illustrates an inductively heatable aerosol-generating device during preparation for use.
Figure 9:
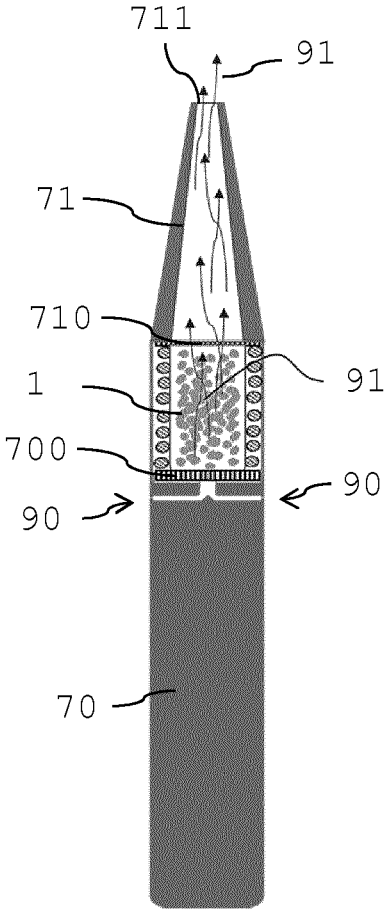
FIG. 9 illustrates the device of FIG. 8 in operation.

The inductively heatable aerosol-generating device shown in FIG. 8 and FIG. 9 comprises a main housing 70 and a mouthpiece 71. The main housing 70, preferably in tubular form, comprises a cavity 701 for receiving a plurality of inductively heatable particles 1, preferably particles as described herein. The main housing 70 also comprises an inductor, here in the form of an induction coil 703, for inductively heating the susceptor core of the particles 1 arranged in the cavity 701. The induction coil 703 is arranged to surround the cavity in longitudinal direction and to be able to heat inductive material arranged in the cavity 701.

The main housing 70 also comprises a battery and a power management system (not shown).

The mouthpiece 71 forms the proximal or most downstream element of the device.

The bottom of the cavity 701 as well as the bottom or distal end of the mouthpiece 71 is closed by a porous element 700,710 for example a porous material or a grid or mesh. The porous elements 700,710 (in the mounted state of the mouthpiece as shown in FIG. 9) are adapted to hold the particles 1 in the cavity 701 and to allow an airflow to pass through the porous elements, through the cavity 701 and into and through the mouthpiece 71.

The main housing 70 is provided with air-inlet channels 702 to allow air 90 from the environment to enter the housing 70 and pass into the cavity 701. Therein, the air 90 picks up aerosol formed in the cavity by heating the particles 1. The aerosol containing air 91 continuous further downstream leaving the device through an outlet opening 711 of the mouthpiece 71 at the proximal end of the mouthpiece, which airflow 90, 91 is illustrated in FIG. 9.

As shown in FIG. 8 a reservoir 8 may be provided for particles 1. The reservoir 8 may comprise an amount of particles corresponding to one refill of the cavity 701. Preferably, the reservoir 8 comprises an amount of particles sufficient for a plurality of refills of the cavity 701. The reservoir 8 may contain a predefined mixture of particles 1 or may contain identical particles. By the availability of a plurality of particles in a reservoir 8, a user may dose or mix particles according to his or her needs.

Upon preparing a device for use, the mouthpiece 71 may be removed from the main housing 70 such as to provide open access to the cavity 701. Removal may be a complete detachment of the mouthpiece 71 from the housing 70 as shown in the example of FIG. 8. Removal may also be an incomplete removal, for example a hinging away of the mouthpiece, where the mouthpiece 71 remains connected to the housing 70 via a hinge.

The cavity 701 may then be filled with a desired amount of particles 1. After repositioning of the mouthpiece 71 on the housing 70 the device is ready for being used.

The invention claimed is:

1. An individual particle comprising:

a core of susceptor material; and a first coating comprising a first aerosol-forming substrate, wherein the core of susceptor material is individually coated with the first coating comprising the first aerosol-forming substrate.

2. The particle of claim 1, being a granule or flake.

3. The particle of claim 1, wherein a maximum size of the particle is 6 mm.

4. The particle of claim 1, wherein the core of susceptor material is a susceptor granule or susceptor flake.

5. The particle of claim 4, wherein a size of a susceptor granule is between 0.2 mm and 2.4 mm and wherein a maximal length of a susceptor flake is between 0.2 mm and 4.5 mm.

6. The particle of claim 1, wherein a first thickness of the first coating is between 0.05 mm and 4.8 mm.

7. The particle of claim 1, further comprising a second coating comprising a second aerosol-forming substrate.

8. The particle of claim 7, wherein a second thickness of the second coating is between 0.05 mm and 4 mm.

9. The particle of claim 7, wherein the first coating comprising the first aerosol-forming substrate and the second coating comprising the second aerosol-forming substrate differ in at least one of composition, porosity, coating thickness or shape of coating surface.

10. The particle of claim 1, further comprising at least one protection layer.

11. The particle of claim 10, wherein the protection layer is an outer most material of the particle.

12. The particle of claim 1, wherein the core of susceptor material is a metallic susceptor particle.

13. An aerosol-generating system comprising:

a plurality of individual particles, each particle comprising a core of susceptor material and at least one individual coating comprising an aerosol-forming substrate; and a power source connected to a load network, the load network comprising an inductor for being inductively coupled to the core of susceptor material of at least some particles of the plurality of particles.

14. The system of claim 13, further comprising:

an aerosol-generating device comprising:

a device housing comprising a cavity arranged in the device housing, the cavity containing the plurality of particles, and a closure closing a proximal end of the cavity, wherein the closure comprises at least one opening for aerosol generated in the cavity to pass through the closure, the at least one opening having a size smaller than a size of a smallest particle of the plurality of particles, thereby retaining the plurality of particles in the cavity.

15. The system of claim 14, wherein the closure is porous or is in the form of a grid, web or mesh.

16. The system of claim 13, wherein the plurality of particles comprises different types of particles, wherein different types of particles differ in at least one of number of coatings, size, shape, shape or composition of susceptor material, thickness, porosity or composition of aerosol-forming substrate coating, aerosol delivery profile.

17. An aerosol-generating device for use in the system according to claim 13, the device comprising:

a device housing comprising a cavity arranged in the device housing, the cavity having an internal surface adapted to accommodate a plurality of individual particles comprising a core of susceptor material and at least an individual coating comprising aerosol-forming substrate;

an inductor of a load network, which inductor is inductively coupled to the core of susceptor material of the plurality of particles during operation; and a mouthpiece having a distal end closing the cavity, the distal end comprising a porous material, a grid, mesh or web.

* * * * *